United States Patent [19]

McGuire et al.

[11] 4,429,204

[45] Jan. 31, 1984

[54] BUSHING MOUNTED STIRRER SHAFT

[75] Inventors: Howard R. McGuire, Nevada; Carl R. Offutt, Marion, both of Ohio

[73] Assignee: Whirlpool Corporation, Benton Harbor, Mich.

[21] Appl. No.: 275,327

[22] Filed: Jun. 19, 1981

[51] Int. Cl.[3] ..... H05B 6/74

[52] U.S. Cl. ..... 219/10.55 F; 219/10.55 D; 310/89; 310/90

[58] Field of Search ..... 219/10.55 F, 10.55 D, 219/10.55 R; 310/51, 89, 90, 91, 66; 248/27.1, 674, 675, 678, 646

[56] References Cited

U.S. PATENT DOCUMENTS

| | | | |
|---|---|---|---|
| 2,171,988 | 9/1939 | Poole . | |
| 2,720,601 | 10/1955 | Dean | 310/89 |
| 3,127,494 | 3/1964 | Kellough et al. | 219/10.55 F |
| 3,526,737 | 9/1970 | Black | 219/10.55 F |
| 3,872,276 | 3/1975 | Corcoran et al. | 219/10.55 F |
| 3,922,050 | 11/1975 | Lettini et al. . | |
| 4,053,730 | 10/1977 | Baron et al. | 219/10.55 F |
| 4,252,288 | 2/1981 | Behrendt | 248/27.1 |
| 4,296,297 | 10/1981 | Miller | 219/10.55 F |
| 4,335,289 | 6/1982 | Smith | 219/10.55 F |
| 4,343,976 | 8/1982 | Nasretdin et al. | 219/10.55 F |
| 4,357,552 | 11/1982 | MacMillan | 310/90 |

*Primary Examiner*—Roy N. Envall, Jr.
*Assistant Examiner*—Philip H. Leung
*Attorney, Agent, or Firm*—Wood, Dalton, Phillips, Mason & Rowe

[57] ABSTRACT

A seal for sealing a stirrer motor shaft in a microwave oven structure. The seal is provided by a bushing bearing journaling the motor shaft and receiving in a non-circular-hole in the wall of the cabinet defining the microwave oven cavity. The bushing is threaded and receives a threaded securing element cooperating with a shoulder on the bushing to clamp the bushing against the portion of the wall member of the cabinet defining the opening. The bushing is electrically connected to the wall member to define a ground for the motor shaft. The motor includes a housing secured to the bushing to be in spaced relationship to the cabinet wall.

13 Claims, 3 Drawing Figures

BUSHING MOUNTED STIRRER SHAFT

BACKGROUND OF THE INVENTION

1. Field of the Invention

This invention relates to microwave ovens and in particular to means for sealing the stirrer shaft against leakage of RF energy outwardly through the opening through which the shaft extends to support the stirrer within the oven cavity.

2. Description of the Background Art

In one conventional form of microwave oven structure, a stirrer element is provided within the oven cavity for causing distribution of the microwave energy delivery to the cavity for uniform heating of the product being heated in the cavity by the microwave energy. The stirrer is conventionally mounted on the distal end of a stirrer shaft comprising the output drive shaft of an electric motor. The electric motor is conventionally mounted externally of the microwave oven cabinet and the stirrer shaft is passed through a hole in the cabinet to mount the stirrer within the cabinet.

One example of such structure is illustrated in U.S. Pat. No. 3,872,276 of Richard T. Corcoran et al. As shown therein, the stirrer motor shaft extends through a bushing mounted in the cabinet wall so as to permit the stirrer to be mounted for rotation within the oven cavity on the distal end of the stirrer shaft. Corcoran et al recognize that some means must be provided for sealing the shaft opening in the cabinet wall against energy leakage, but do not provide any specific means for effecting such sealing.

The later U.S. Pat. No. 4,053,730 of David Alan Baron et al, addresses the problem of sealing such an opening and more specifically teaches the provision of a metal plate, or disc, in closely spaced relationship to the cabinet wall while being maintained out of physical contact therewith. Baron et al teach the criticality of small spacing of the capacitive sealing disc from the cabinet wall and specify that the spacing should be about 0.125" or less for optimum benefits.

Arthur B. Poole, in U.S. Pat. No. 2,171,988, shows a synchronous electric motor structure wherein a cap portion of the housing is secured to the body portion thereof by a nut engaging a threaded portion of the shaft bushing and bearing against the cap to urge it in nested relationship to the main portion of the motor housing.

Michael J. Lettini et al disclose, in U.S. Pat. No. 3,922,050, an electrical terminal structure wherein a sleeve is caused to expand radially into low resistance electrical contact with a surrounding sheet or body member. The sleeve is extended through a cylindrical hole in the body member and the expansion thereof causes a radial outward engagement of the sleeve in the desired electrical contact with the sheet or body member.

SUMMARY OF THE INVENTION

The present invention comprehends an improved microwave oven structure wherein the stirrer motor shaft is sealed against RF energy leakage outwardly through the shaft opening bearing-bushing mounting.

In the illustrated embodiment, the bearing-bushing is secured to the motor gear case and includes a portion fitted in a complementary opening in the cabinet wall so as to be retained against rotation therein. The bushing is provided with a threaded inner portion on which is threadedly secured a nut.

The bushing includes an outer shoulder portion which is urged against the cabinet wall by the threading of the nut on the threaded inner portion of the bushing so as to clamp the cabinet wall portion between the shoulder and nut and effect a positive electrically conductive connection of the bushing to the cabinet wall.

The stirrer shaft is journaled within the bushing. The stirrer shaft is preferably formed of metal and the bushing is preferably formed of metal so as to provide a positive grounding of the shaft to the cabinet wall in the assembled relationship of the structure.

The housing of the motor may be secured to the bushing as by staking or the like so as to provide a further electrical contact between the housing and the bushing, whereby the motor housing is similarly grounded.

The novel bearing-bushing structure permits grounding of the stirrer shaft without the need for removing paint from the external surface of the cabinet, facilitating assembly and effectively minimizing cost thereof.

The bushing shoulder portion is arranged to space the motor housing from the cabinet wall sufficiently to prevent thermal conductive transfer therebetween, thereby permitting improved long life of the stirrer drive motor means. By eliminating the need for screws to secure the motor housing to the cabinet wall, further improved seal of the structure against RF leakage is obtained.

Thus, the microwave oven stirrer shaft means of the present invention is extremely simple and economical of construction while yet providing the highly improved seal against RF leakage as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
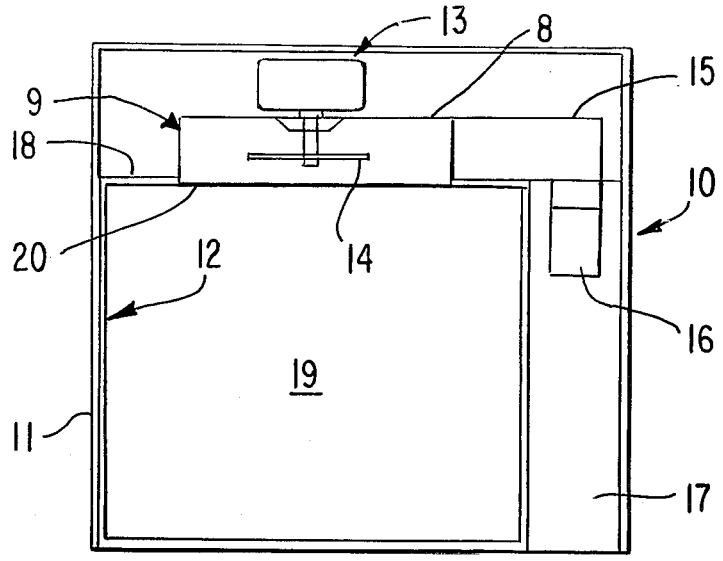
FIG. 1 is a cross section of a microwave oven having stirrer means embodying the invention.

In the exemplary embodiment of the invention as disclosed in FIG. 1, a microwave oven generally designated 10 is shown to comprise a cabinet 11 enclosing a cavity 19 formed by a wall means 12 having attached to the top wall 18, a microwave energy feedbox 9 forming an upper portion of said cavity. A stirring means generally designated 13 is mounted to a top wall portion 8 of feedbox 9. The stirrer means includes a stirrer blade 14 disposed within a waveguide duct 15 receiving microwave energy from a generator means 16 provided in a generating portion 17 of the cabinet 11. The waveguide 15 is mounted to the upper wall 18 of the cavity 19 and microwave energy is delivered into the oven cavity 19 from the guide through a suitable inlet opening 20 in the top wall 18.

As discussed above, the present invention comprehends improved means for mounting the stirring means 13 to the oven cabinet and more specifically defines improved means for sealing the mounting of the stirrer means 13 against RF leakage outwardly from the oven during use.

Figure 2:
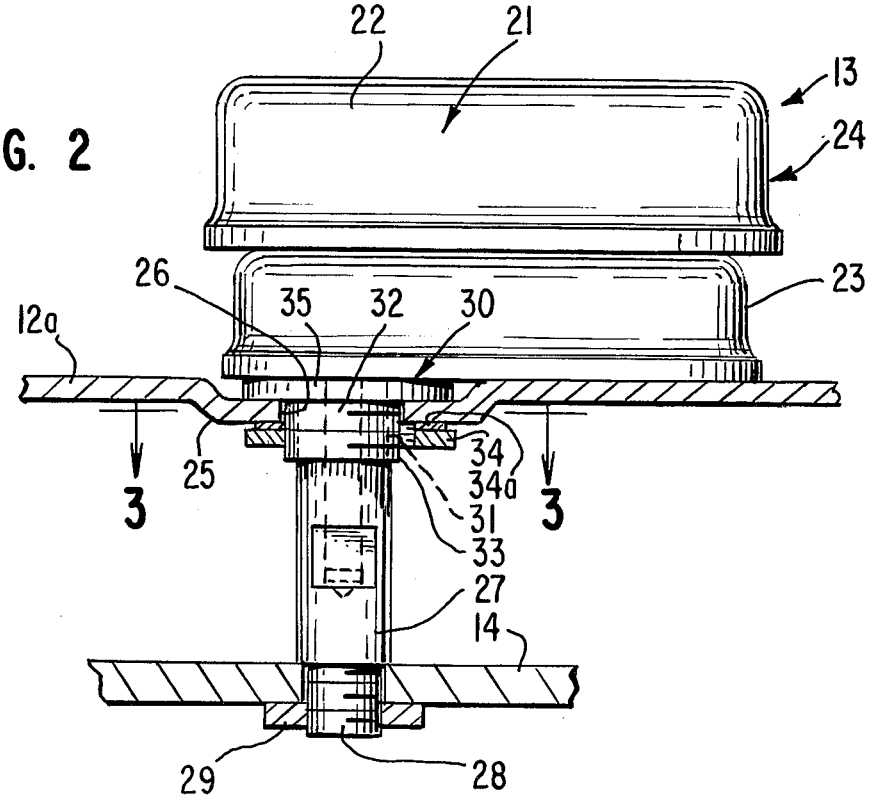
FIG. 2 is a fragmentary enlarged vertical section illustrating the stirrer means in greater detail.

More specifically, as seen in FIG. 2, the stirring means 13 includes a drive means generally designated 21 including a drive motor 22 and a drive gear reduction means 23. The drive motor and gear reduction means are mounted in suitable housing means generally designated 24.

Figure 3:
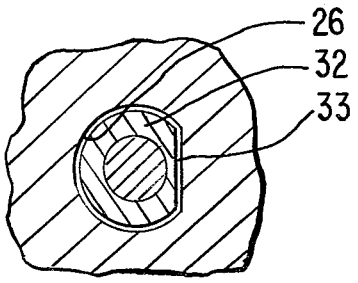
FIG. 3 is a horizontal section taken substantially along the line 3—3 of FIG. 2.

Feedbox top wall 8, to which the stirring means 13 is mounted, defines a dished portion 25 having a through opening 26 which, in the illustrated embodiment, is of noncircular cross section, and more specifically as shown in FIG. 3, is a D-shaped cross section.

As shown in FIG. 2, the stirrer drive means 21 is provided with an output drive shaft 27 which includes a threaded distal end 28 to which the stirrer blade 14 is secured by a suitable nut 29 for rotation of the stirrer blade with the drive shaft 27 within the feedbox 9.

The invention comprehends improved means for concurrently mounting the motor to the feedbox top wall 8, grounding the drive shaft 27 to the feedbox 9, and journaling the drive shaft for rotation of the stirrer blade within the oven cavity. More specifically, as seen in FIG. 2, drive shaft 27 is journaled in a bearing-bushing 30 having an axial passage 31 rotatably journaled the shaft 27. The bushing includes a cylindrical stem portion 32 having a flat 33 thereon such that the stem is complementary to and fitted in the opening 26 for nonrotative association of the bushing with the feedbox 9. The cylindrical stem portion is threaded on its outer surface 32*a* to receive a threaded securing element, such as nut 34. The nut 34 may be provided with a serrated face or a separate external tooth star washer 34*a* may be used to improve electrical conductivity to the cavity wall 12*a*, if the wall is painted.

As further shown in FIG. 2, the bushing further includes a head portion 35 defining a radially enlarged shoulder overlying the edge of the feedbox top wall 8 defining the opening 26.

Thus, when nut 34 is threaded forcibly against the underside of the top wall 8 to draw the head portion 35 downwardly against the upper side of the top wall, the bushing is effectively positively secured to the top wall 8 with the nut 34 being in positive electrical engagement association with the top wall to effectively ground the bearing 30 and the motor shaft 27 journaled therein. As the nut effectively closes the opening 26, the opening is sealed against RF leakage outwardly therethrough.

In the illustrated embodiment, the housing 24 of the motor drive means 21 is secured to the bushing portion 35 as by staking. In the illustrated embodiment, the bushing is formed of metal and, thus, electrically grounds the housing to the wall portion 12 concurrently with the grounding of the shaft 27 thereof to the wall portion 12.

Thus, the stirring means 13 is mounted to the feedbox top wall 9 in a novel manner so as to effectively preclude RF energy loss outwardly through the stirrer shaft opening by novel and simple means for effectively mounting the drive means 21 to the top wall 9. The invention permits the drive shaft 27 to be formed of a strong material, such as metal, avoiding the problems of the prior art wherein RF leakage problems were solved by providing nonmetallic shafts. Further, the improved mounting means permits the mounting of the stirring means 13 without the need for removing paint from the outer surface of the cabinet wall portion 12 as has been required in other prior art structures.

The means for mounting the stirrer in the present invention is extremely simple and economical of construction while yet providing the improved prevention of RF energy loss, and simplified assembly of the structure for effectively minimizing cost of the microwave oven structure 10.

The foregoing disclosure of specific embodiments is illustrative of the broad invention concepts comprehended by the invention.

We claim:

1. In a microwave oven having a painted cabinet defining a cavity for receiving food to be cooked therein and having a wall portion provided with a through opening forming a noncircular cross section, means for providing microwave energy to said cavity, a stirrer within said cavity for distributing said energy as it is provided to said cavity, and drive means exteriorly of said cavity for driving said stirrer, said drive means including a drive motor having an output drive shaft projecting through said opening in said wall portion and being connected to said stirrer, improved mounting means for mounting said motor to said wall portion and sealing said opening against leakage of microwave energy from said cavity outwardly therethrough, said mounting means comprising:

a bushing formed of electrically conductive material and defining a through passage providing a bearing surface for said shaft, and having a stem portion complementary to and fitted in said opening for nonrotative association with the cavity wall portion, said bushing further having a second threaded outer surface disposed within said cavity, and a head portion overlying an edge of said wall portion defining said through opening exteriorly of said cavity;

means fixedly securing the bushing to the drive means; and retaining means within said cavity and threaded to said threaded outer surface of said bushing for forcibly clamping said edge of the wall portion between said bushing head portion and said retaining means for positively securing the bushing directly to the wall portion in electrically connected association for retaining said bushing and drive means carried thereby to said cavity wall portion.

2. The microwave oven structure of claim 1 wherein said means for securing the bushing to the drive means comprises means for staking the bushing to said drive motor.

3. The microwave oven structure of claim 1 wherein said through opening comprises a D-shaped opening.

4. The microwave oven structure of claim 1 wherein said stem portion of the bushing defines a continuous threaded surface having a flat at one side providing a D-shaped cross section.

5. The microwave oven structure of claim 1 wherein said retaining means includes a star washer means for insuring electrical conductivity between the bushing and the cavity wall portion.

6. The microwave oven structure of claim 1 wherein said retaining means comprises a nut threaded on said bushing into abutment with said cavity wall portion.

7. The microwave oven structure of claim 1 wherein said cavity wall portion comprises a dished portion of a top wall in forming said cavity.

8. In a microwave oven having a wall member defining an opening, drive means having a housing and a drive shaft extending rotatably from said housing through said opening, and a stirrer element, the improvement comprising:

a bearing element having a through bore, said drive shaft being rotatably journaled in said bore with the distal end of the shaft projecting therefrom, said stirrer element being secured to said projecting portion for rotation therewith;

securing means for fixedly securing said bearing element directly to said wall member at said opening against rotational and axial displacement; and mounting means for fixedly mounting said drive means housing to said bearing element.

9. The microwave oven structure of claim 8 wherein said securing means comprises means for clamping the bearing element to said wall member.

10. The microwave oven structure of claim 8 wherein said opening defines a noncircular cross section and said bearing element defines a stem portion having a complementary cross section disposed in said wall member opening to prevent rotation of the bearing element about the axis of said bore.

11. The microwave oven structure of claim 8 wherein said bearing element is formed of metal.

12. The microwave oven structure of claim 8 wherein said housing, said wall member and said bearing element are formed of metal and said securing means includes metallic means threadedly secured to said bearing element and engaging said wall member in electrically conductive association for grounding said drive shaft and housing to said wall member.

13. The microwave oven structure of claim 8 wherein said wall member and said bearing element are formed of metal and said securing means includes metallic means threadedly secured to said bearing element and engaging said wall member in electrically conductive association for grounding said drive shaft to said wall member.

* * * * *